US010462581B2

(12) United States Patent
Wurzbacher et al.

(10) Patent No.: US 10,462,581 B2
(45) Date of Patent: Oct. 29, 2019

(54) METHOD OF DETECTING A DEFECT IN A HEARING INSTRUMENT, AND HEARING INSTRUMENT

(71) Applicant: SIVANTOS PTE. LTD., Singapore (SG)

(72) Inventors: Tobias Wurzbacher, Fuerth (DE); Tobias Daniel Rosenkranz, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/124,408

(22) Filed: Sep. 7, 2018

(65) Prior Publication Data

US 2019/0075403 A1 Mar. 7, 2019

(30) Foreign Application Priority Data

Sep. 7, 2017 (DE) ..... 10 2017 215 825

(51) Int. Cl.
*H04R 25/00* (2006.01)

(52) U.S. Cl.
CPC ..... *H04R 25/30* (2013.01); *H04R 25/305* (2013.01); *H04R 25/405* (2013.01); *H04R 25/505* (2013.01)

(58) Field of Classification Search
CPC ..... G10K 11/1781; G10K 11/17813; G10K 11/178833; H04R 25/305; H04R 25/453; H04R 25/45; H04R 25/30
USPC ..... 381/56–60, 104–109, 71.4
See application file for complete search history.

(56) References Cited

U.S. PATENT DOCUMENTS 7,242,778 B2 * 7/2007 Csermak ..... H04R 25/305 381/315
8,953,818 B2 * 2/2015 Elmedyb ..... H04R 25/453 381/318
9,486,823 B2 * 11/2016 Andersen ..... B05B 7/0884
2003/0007647 A1 1/2003 Nielsen et al.
2005/0259829 A1 11/2005 Van Den Heuvel et al.
2010/0074451 A1 * 3/2010 Usher ..... H04R 25/70 381/58
2010/0166198 A1 7/2010 Perman
2010/0202641 A1 * 8/2010 Guo ..... H04R 25/453 381/318
2014/0254805 A1 * 9/2014 Su ..... H04R 3/007 381/55
2015/0092948 A1 4/2015 Usher et al.
(Continued)

FOREIGN PATENT DOCUMENTS

EP 1467595 A2 10/2004
WO 2018129242 A1 7/2018

*Primary Examiner* — Disler Paul
(74) *Attorney, Agent, or Firm* — Laurence A. Greenberg; Werner H. Stemer; Ralph E. Locher

(57) ABSTRACT

A method for detecting a defect in a hearing instrument that has at least one first input transducer and at least one output transducer. A first transfer function of a first acoustic system, which includes the output transducer and the first input transducer, is determined, and at least a first reference function for the first transfer function is determined. The first transfer function is compared with the first reference function and a defect in the hearing instrument is detected based on the comparison. A hearing instrument with an input transducer and an output transducer is set up to carry out the method.

16 Claims, 8 Drawing Sheets

(56) References Cited

U.S. PATENT DOCUMENTS

| | | | | |
|---|---|---|---|---|
| 2015/0124977 | A1* | 5/2015 | Srivastava | H04R 25/305<br>381/58 |
| 2017/0070826 | A1 | 3/2017 | Pedersen et al. | |
| 2018/0115815 | A1* | 4/2018 | Kumar | H04R 3/00 |

* cited by examiner

METHOD OF DETECTING A DEFECT IN A HEARING INSTRUMENT, AND HEARING INSTRUMENT

CROSS-REFERENCE TO RELATED APPLICATION

This application claims the priority, under 35 U.S.C. § 119, of German patent application DE 10 2017 215 825.5, filed Sep. 7, 2017; the prior application is herewith incorporated by reference in its entirety.

BACKGROUND OF THE INVENTION

Field of the Invention

The invention relates to a method for detecting a defect in a hearing instrument that has at least a first input transducer and at least one output transducer.

In a hearing device, sound signals from the environment are converted into electrical signals by one or more input transducers, and these signals are further processed by a signal processor or the like. They are then converted back into an output sound signal by an output transducer. The output sound signal is fed to the ear of a user, who usually has a hearing impairment. In this way, the electrical signals in the signal processor are processed, as much as possible, so as to compensate for this impairment through corresponding processing.

For this purpose, as far as possible, error-free functioning of the electroacoustic hardware components, i.e. the input transducer and the output transducer, is particularly necessary. These components in hearing devices typically lose aspects of their performance with increasing operating time, i.e., at comparable sound pressures the input transducers will produce electrical signals of increasingly lower amplitudes, while the output transducer over time generates an increasingly lower sound pressure from a normalized test signal. This loss of performance capacity, which is primarily due to wear of the electroacoustic components, is aggravated by the fact that the components in the hearing device are exposed to the influences of moisture or sebum when worn in the ear. Malfunction of the hearing device is therefore often caused by a corresponding damage or impairment of one of the electroacoustic hardware components.

A total failure of one of these components—i.e. of one of the input transducers or the output transducer—is easy for the user of the hearing device to recognize. A merely gradual decrease in performance, however, as occur for example through attenuation or underperformance in a particular frequency range, is often quite difficult for the user, or a hearing aid acoustician, to recognize without a specific measurement. This results in a long-term operation of the hearing device with a correction for the user's hearing impairment that is not adequate for the user's hearing impairment; this also may affect the user's engagement in the world and ability to concentrate, due to the consequently reduced intelligibility of speech.

Such problems with electroacoustic hardware components may also occur in other hearing instruments such as mobile telephones. Here too, a defect in an input transducer is difficult for the user to recognize, because the user may not even be able to check the input signal generated from the user's own speech, and thus may have to rely on statements from the people the user is speaking to. Also, a wideband attenuation in the output transducer is difficult for the user to recognize, especially because of mobile telephone users' tendency to attribute shortcomings in the output sound signal primarily to inadequate signal transmission through the mobile network. Moreover, even when worn on the body, e.g. in a trouser or jacket pocket, mobile telephones are potentially exposed to influences such as moisture and impacts that may impair the electroacoustic components.

Detecting possible deterioration of the device's proper operation over a longer period of operation is thus a general problem for hearing instruments that have electroacoustic components.

SUMMARY OF THE INVENTION

The object of the invention, accordingly, is to provide a method for detecting a defect in a hearing instrument, the method being as simple as possible to carry out with high reliability and requiring no additional conditions of the hearing instrument in order to be carried out; and in particular, requiring no additional devices.

With the above and other objects in view there is provided, in accordance with the invention, a method of detecting a defect in a hearing instrument having at least one first input transducer and at least one output transducer. The novel method comprises:

- determining a first transfer function of a first acoustic system including the output transducer and the first input transducer;
- determining at least a first reference function for the first transfer function;
- comparing the first transfer function with the first reference function; and
- detecting a defect in the hearing instrument based on a result of the comparing step.

In other words, the invention provides for a method for detecting a defect in a hearing instrument, wherein a first transfer function of a first acoustic system, comprising the output transducer and the first input transducer, is determined, and at least a first reference function is determined for the first transfer function. The first transfer function of the first acoustic system is compared with the first reference function, and a defect in the hearing instrument is detected based on this comparison.

The term "hearing instrument," as used herein, generally refers to any device in which a sound signal of the environment is converted by an electroacoustic input transducer to an internal electrical signal, and an output sound signal is generated from an electrical output signal of the device by an electroacoustic output transducer, i.e., in particular a hearing device and a mobile telephone.

Preferably, in this case, the hearing instrument also has a signal processing unit, and during operation the first input transducer generates a first input signal from a sound signal of the environment, this input signal is supplied to the signal processing unit, the signal processing unit emits an output signal, and the output transducer converts this output signal into an output sound signal. The output signal in this case may be based on the input signal, as is the case in a hearing device, or it may be based on a signal received via an antenna, as is the case in a mobile telephone. In the latter case, the signal processing unit may in particular be set up to prepare the input signal for transmission via a transmitting antenna—for example by coding it in a transmission protocol—and to decode a signal received at a receiving antenna and convert it into an output signal.

The determination of the first reference function may be carried out, in particular, before determining the current first transfer function. In this case, the first reference function may in particular also be "trivial," in other words, given by a frequency-independent limit value for the first transfer function or for the magnitude of the first transfer function. Preferably, however, the reference function is non-trivial, and thus frequency-dependent.

By determining a transfer function for an acoustic system comprising the first input transducer and the output transducer, advantageous information is provided, in particular for the purpose of detecting defects in these components. As a result of using the transfer function, this information is also available in frequency-resolved form, which simplifies analysis with regard to a defect. The determination of the first transfer function preferably takes place without using an external sound generator to stimulate or inspect the first input transducer or using an additional external microphone to inspect the output transducer. This may be achieved by a suitable selection of the first acoustic system.

In this case, the first reference function should be determined in such a way that it may serve as a reference for the first transfer function when the hearing instrument is fully functional, i.e. free of defects. By comparing the first transfer function with the first reference function, for example, those frequency ranges in which the functionality of the hearing instrument is impaired may be identified. To more precisely localize the defect, the first transfer function and first reference function may now be examined, particularly in the frequency domain and time domain. This provides additional information content and may allow conclusions to be drawn as to exactly which component a defect is present in, i.e. whether the defect is present at the first input transducer or the output transducer. A defect of the output transducer may result in an impulse response of the first transfer function which is considerably weakened compared to the values of the first reference function, while a defect of the input transducer may, among other things, have a impulse response of the first transfer function that is time-shifted relative to the values of the first reference function.

Conveniently, the open loop transfer function is determined as the first transfer function of the first acoustic system, the open signal loop being formed from the output transducer, an acoustic feedback path from the output transducer to the first input transducer, and the first input transducer. The open loop transfer function may be determined in a particularly simple manner, for example by means of a suitable test signal, which is converted by the output transducer into a test sound signal, and by an analysis of the signal component of the test signal in a first input signal generated by the first input transducer, to estimate on this basis the portion of the test sound signal arriving at the first input transducer. Another advantage of using the open signal loop as the first acoustic system, and thus using the open loop transfer function as the first transfer function, is that the first input transducer and the output transducer are completely within that system, so that there is no need for any additional sound generators or any additional measuring apparatus.

In this case, preferably, an additional closed loop transfer function is determined, and from this, the open loop transfer function is determined as the first transfer function, wherein the closed signal loop is formed from the output transducer, an acoustic feedback path from the output transducer to the first input transducer, the first input transducer, and a signal processing path from the first input transducer to the output transducer. The closed signal loop is thus formed by the open signal loop, which is closed from the input transducer to the output transducer by the signal processing path. This is advantageous, particularly in a hearing instrument designed as a hearing device, because a closed loop transfer function is often determined in the context of suppressing acoustic feedback anyway, and thus there is no need for any additional measurements or functionality.

Preferably, the closed loop transfer function is determined by an adaptive filter, wherein the open signal loop is determined based on the closed signal loop, taking into account a signal processing that takes place along the signal processing path. This may be achieved in particular by correcting the closed loop transfer function, which has been determined by the adaptive filter, by a corresponding transfer function of the internal signal processing processes that take place along the signal processing path of the hearing instrument, because these processes are presumed to be completely known.

Advantageously, in this case, the adaptive filter is used in the hearing instrument for suppressing acoustic feedback via the acoustic feedback path running from the output transducer to the first input transducer. This means, in particular, that the adaptive filter is furnished and set up for feedback suppression as needed during normal use of the hearing instrument, and that the adaptive filter may be used in the context of detecting a defect in the hearing instrument by accessing the closed loop transfer function that was determined for the purpose of feedback suppression. Optionally, the adaptive filter may also be operated in a dedicated mode for detecting a hearing instrument defect.

Alternatively, a test signal is supplied to the output transducer, a test sound signal is generated from the test signal by the output transducer, a first input signal is generated by the first input transducer from an input sound comprising the test sound signal, and the open loop transfer function is determined as a first transfer function from the input signal and the test signal. This means that the open loop transfer function is determined by direct measurement. In particular, in this case the spectral power density of the test signal is constant over the frequency, so the test signal is "white noise". A direct measurement of the open loop transfer function may thus be realized with particular ease. This also applies to the case in which the hearing instrument is provided via a mobile telephone, because for this purpose the loudspeaker only needs to generate the test sound signal, and only the component of the test sound signal that reaches the microphone needs to be measured there.

In particular, the determination of the first transfer function takes place at predetermined intervals, i.e. either regularly or based on the respective duration of the operating phases. The first transfer function may also be determined via user input. In particular, in this case, the user input may activate the complete method for detecting a defect, for example if the user subjectively perceives that there is a malfunction in the hearing instrument and wants to obtain objective clarity on that point. Also, the complete method for detecting a defect may be performed regularly or based on the respective duration of the operating phases, for example, as part of a maintenance program or the like.

In an advantageous configuration, a cross-correlation is used for comparing the first transfer function with the first reference function. The cross-correlation, in this case, may be taken in particular from the first transfer function and first reference function in the frequency domain and/or from the first transfer function and the first reference function in the time domain, in which the impulse response of the first acoustic system is specified. The cross-correlation is used in particular as an additional criterion for monitoring deviations of the first transfer function with respect to the first reference function. In particular, the corresponding correlation coefficient may be used. This has the advantage that, in the case of a frequency-band-wise deviation between the first transfer function and the first reference function, the degree of deviation is difficult to quantify and in particular is more difficult to put in relation to other scenarios. To this end, the correlation coefficient provides a single value that affords such comparability.

Expediently, the first reference function is determined from a measurement of the first transfer function under normalized conditions. In particular, for a hearing device, this determination may take place at a hearing aid acoustician. Such a measurement is particularly easy to implement as part of a fitting session that is taking place anyway. In the case of a mobile telephone, such a measurement may be taken at the manufacturer or at a qualified distributor.

Alternatively, the first reference function may be determined by time-averaging multiple values of the first transfer function at different times. The values may be determined at multiple times in particular by a routine detection of the values during a predetermined operating interval after initial operation, e.g. in the first days. This is based on the assumption that the hearing instrument is still fully functional at the start of operation, and therefore the initially detected values of the first transfer function are a suitable basis for the first reference function, and that averaging over a plurality of values is advantageous for a true reference, irrespective of the respective conditions at the time at which the respective value has been determined. This procedure is particularly advantageous if the first transfer function cannot be directly measured under normalized conditions—for example, if a fitting session at a hearing aid acoustician is not contemplated when putting a hearing device into operation.

Advantageously, the first transfer function is determined by time-averaging a plurality of values of the open loop transfer function. In this way, it is possible to compensate for short-term fluctuations. In this case, the time averaging preferably comprises those values that reflect the current status of the hearing instrument as accurately as possible, which may be achieved in particular by a significant weighting of the most recent values. The determination of the values of the open loop transfer function, in this case, may take place in the background over a longer period of time, and the determination of the first transfer function from these values may then take place over a decreasing weighting of the values during averaging.

Preferably, a defect of the first input transducer and/or the output transducer is detected. The method described is particularly suitable for detecting defects in these components.

Conveniently, a measure is determined for a correlation between the first transfer function and the first reference function, wherein the defect is detected based on the measure of correlation. A cross-correlation may for example be used as a measure of correlation.

Alternatively or additionally, a first polynomial, which approximates the first transfer function, and a first reference polynomial, which approximates the first reference function, may be determined, the defect being recognized with reference to the first polynomial and the first reference polynomial based on a coefficient comparison. In this case, for example, a threshold value may be predetermined for the deviation of the polynomial coefficients from each other, above which it is concluded that there is a defect in the hearing instrument. The threshold value may be selected differently for each of the respectively different orders of polynomial coefficients. In particular, as a criterion for a defect in the hearing instrument, in addition to the aforementioned coefficient comparison, the aforementioned measure of the correlation of these transfer functions may also be used.

It is also advantageous if when a second transfer function of a second acoustic system comprising the output transducer and a second input transducer of the hearing instrument is determined, at least a second reference function is determined for the second transfer function, the second transfer function is compared with the second reference function, and a defect in the hearing instrument is detected based on the comparison of the first transfer function with the first reference function and of the second transfer function with the second reference function. This is advantageous for hearing instruments that have a second input transducer, such as for example certain embodiments of hearing devices.

In particular, a comparison of the first transfer function with the second transfer function is additionally used for detecting a defect in the hearing instrument. In addition, this comparison also makes it easier to localize the defect. In rough terms, there are at least three possibilities for a defect in electroacoustic hardware: the two input transducers and the output transducer. The aforementioned comparisons of the transfer function with the corresponding reference function relate respectively either to an input transducer and the output transducer, or to both input transducers, because the contribution of the output transducer may be eliminated when comparing the first and second transfer functions, for example by simple subtraction.

In particular, the first and second transfer functions may be compared with the respectively associated first or second reference function, and also with each other, on the basis of a measure for the correlation of the transfer functions and/or reference functions. Alternatively or additionally, two transfer and/or reference functions to be compared may each respectively be approximated by polynomials, and a comparison of the relevant polynomial coefficients may be used to compare the aforementioned functions.

The second reference function may be determined in particular before determining the current second transfer function. In this case, the second reference function may in particular also be "trivial," that is to say, it may be given by a frequency-independent limit value for the second transfer function or the magnitude of the second transfer function. Preferably, however, the reference function is non-trivial, and thus frequency-dependent.

Expediently, in this case, a first limit value, a second limit value and a third limit value are predetermined, a first difference being taken from the first transfer function and the first reference function, a second difference being taken from the second transfer function and the second reference function, and a third difference being taken from the first transfer function and the second transfer function. A defect in the first input transducer is detected when the first difference exceeds the first limit value in at least one frequency range but the second difference does not exceed the second limit value, and/or a defect in the output transducer is detected when there are respectively different frequency ranges for the first difference and the second difference, in which these exceed the first limit value or the second limit value but the third difference does not exceed the third limit value. In particular, in this case, the first limit value and the second limit value are identical. This embodiment is particularly easy to implement due to the low complexity of the computational operations used.

The invention also describes a hearing instrument with at least a first input transducer and an output transducer, which is set up to carry out the method described above. The advantages stated for the method and the developments thereof apply analogously to the hearing instrument. Preferably, the hearing instrument for carrying out the method comprises a control unit that has been set up correspondingly. This unit may for example also be implemented in a signal processing unit of the hearing instrument by means of corresponding command blocks.

In a particularly advantageous configuration, the hearing instrument is designed as a hearing device. Especially for the input and output transducers used in hearing devices, and in view of possible environmental influences to which a hearing device and its components are exposed during operation, this method is particularly practical for detecting a defect without the need for a costly measurement at a hearing aid acoustician.

Other features which are considered as characteristic for the invention are set forth in the appended claims.

Although the invention is illustrated and described herein as embodied in a method of detecting a defect in a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Corresponding parts and sizes are assigned the same reference numerals in all drawing figures.

DETAILED DESCRIPTION OF THE INVENTION

Figure 1:
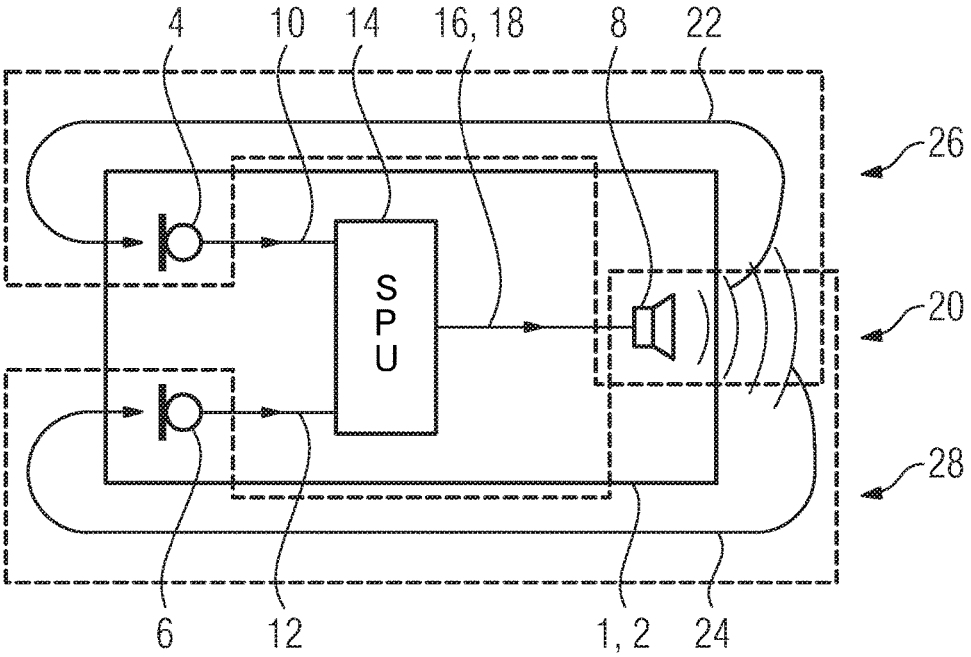
FIG. 1 is a block diagram of a hearing device in which a method for detecting defects of individual components is implemented.

Referring now to the figures of the drawing in detail and first, particularly, to FIG. 1 thereof, there is shown a schematic block diagram of a hearing instrument 1, which is designed as a hearing device 2. The hearing device 2 comprises a first input transducer 4 and a second input transducer 6, each being a microphone, in addition to an output transducer 8 provided by a loudspeaker. The first input transducer 4 and the second input transducer 6 are set up to respectively convert a sound signal into a first input signal 10 and a second input signal 12, respectively. The first input signal 10 and second input signal 12 are respectively supplied to a signal processing unit (SPU) 14 in which the hearing-device-specific processing takes place, i.e., in particular a frequency band-dependent amplification of the input signals 10, 12 as a function of the user's hearing impairment, and the signal-to-noise ratio is also improved, for example by means of a directional microphone processing. The signal processing unit 14 generates an output signal 16, which the output transducer 8 converts into an output sound signal.

To detect a defect at the first input transducer 4, second input transducer 6 or output transducer 8, when the hearing device 2 is operating, the signal processing unit 14 outputs a test signal 18 as the output signal 16, and this signal is converted into a test sound signal 20 by the output transducer 8. In the present case, the test sound signal 20 is substantially white noise; in other words, it has a substantially flat frequency spectrum. But other types of signals are also conceivable here, such as sine tones of different frequencies, chirps, "perfect sweeps" or the like, which allow determinations about as broad a frequency spectrum as possible.

The first input transducer 4 and second input transducer 6 now respectively convert the corresponding sound signals into input signals 10 and 12, and thus also convert the component of the test sound signal 20 arriving at the respective input transducers 4, 6 via the corresponding acoustic feedback path 22 or 24 that runs from the output transducer 8 to the input transducer 4, 6.

With respect to the first input signal 10 and the output signal 8, a first transfer function T1 is determined for a first acoustic system 26 that is formed by the open signal loop from the output transducer 8 via the acoustic feedback path 22 to the first input transducer 4. This may be done by directly measuring the component of the test signal 18 in the first input signal 4, or it may be done via an estimate based on the closed signal loop formed from the first acoustic system 26, i.e. the open signal loop, and the signal processing unit 14. The closed signal loop or the transfer function thereof is often already available in hearing devices because it has already been determined for the purpose of suppressing acoustic feedback via the acoustic feedback path 22.

In addition, a second transfer function T2 is determined based on the second input signal 12 and the output signal 8 for a second acoustic system 28 that is formed by the open signal loop that runs from the output transducer 8 via the acoustic feedback path 24 to the second input transducer 6.

A first reference function and a second reference function are now respectively stored for the first transfer function T1 and the second transfer function T2. This may take place by means of measurements of the first transfer function T1 and the second transfer function T2 under normalized conditions at a hearing aid acoustician, or alternatively by time-averaging the respective values of the first transfer function T1 or T2 during the first days after the device is put into operation, because it may be presumed that at this time, the hardware components to be inspected are still fully functional.

The respectively currently determined first or second transfer function T1, T2 is now compared with the corresponding reference functions in order to be able to conclude from this that there is a possible defect of the hardware components. This will be explained with reference to FIGS. 2 to 4.

Figure 2A:
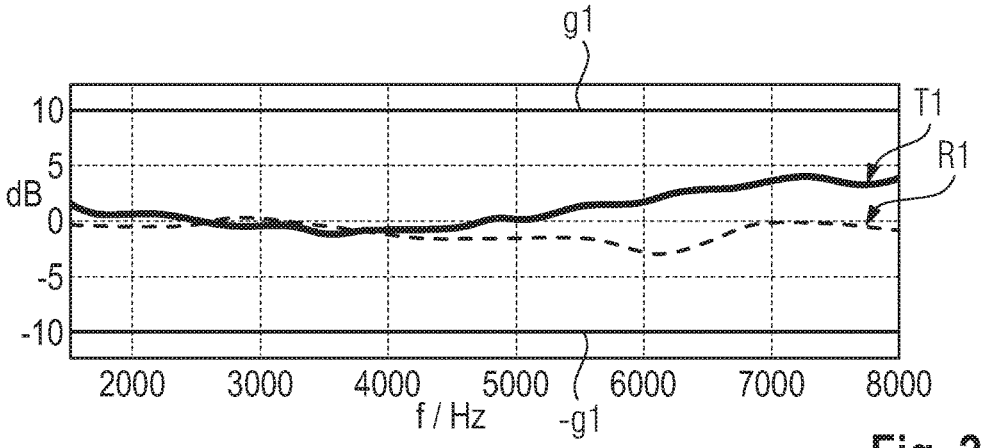
FIGS. 2A, 2B and 2C are graphs with comparisons of two transfer functions with the associated reference functions and with each other, in three frequency band diagrams for an interference-free hearing device.
Figure 2B:
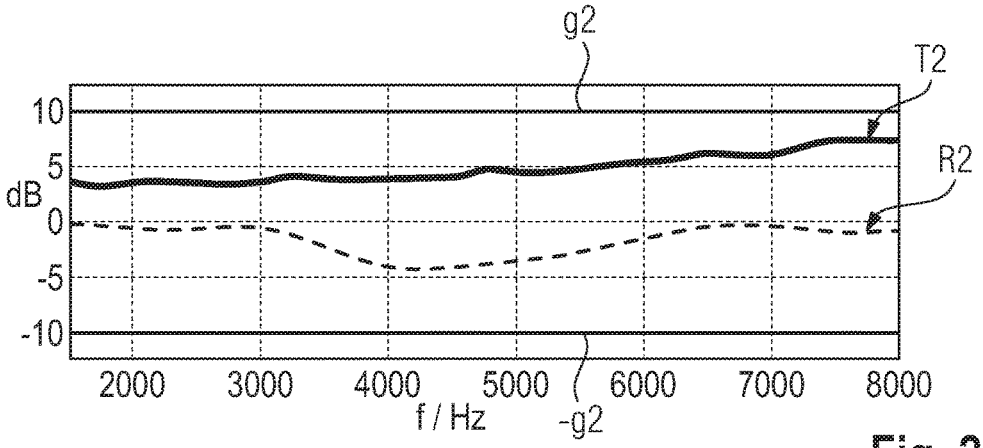
Figure 2C:
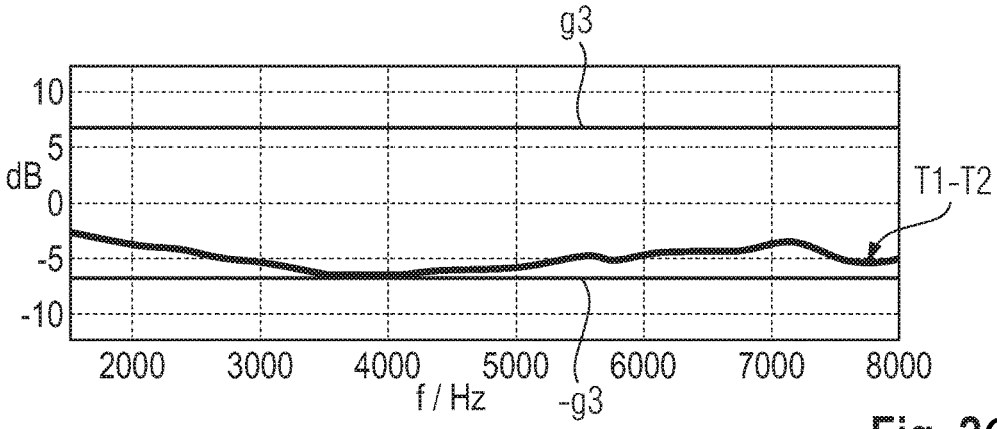

FIGS. 2A-2C show respectively, in a frequency band diagram relative to the frequency f: the first transfer function T1 and the first reference function (FIG. 2A), the second transfer function T2 and the second reference function R2 (FIG. 2B), and the difference between the first transfer function T1 and the second transfer function T2 (FIG. 2C). In FIG. 2A, the first transfer function T1 remains within a corridor over the entire frequency range shown, which is predetermined by the first limit value g1 of 10 dB. In addition, the first transfer function T1 does not record any significant deviations from the first reference function R1, which represents the undisturbed operation of the hearing device 2. The second transfer function T2 illustrated in FIG. 2B is also within the corridor over the entire frequency range shown, which is predetermined by the second limit value g2 of 10 dB. Likewise, there are no significant deviations from the second reference function R2. The difference T1-T2 of the first and second transfer function T1 or T2 lies within the corridor determined by the third limit value g3, as may be seen from FIG. 2C. The hearing device 2 thus operates without interference.

Figure 3A:
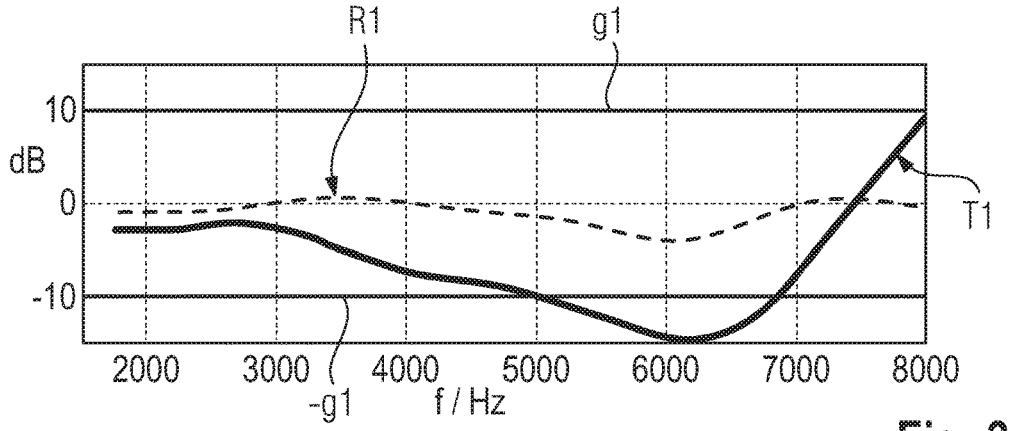
FIGS. 3A, 3B and 3C are graphs with comparisons of two transfer functions with the associated reference functions and with each other, in three frequency band diagrams for a hearing device with a defective input transducer.
Figure 3B:
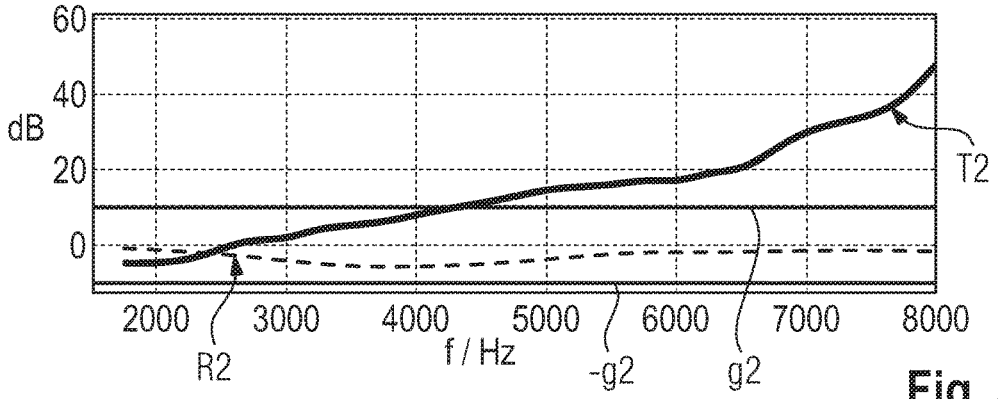
Figure 3C:
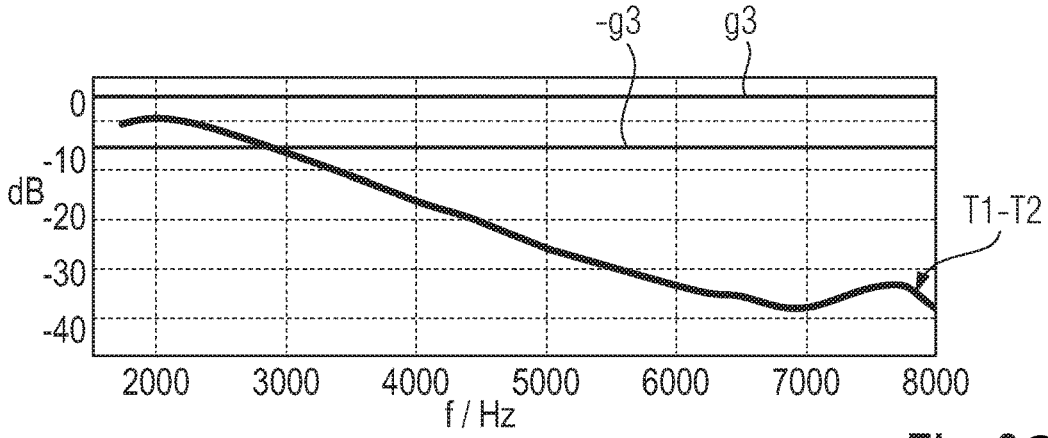

In FIGS. 3A-3C, the same dimensions are shown as in FIGS. 2A-2C. But here, for a small frequency range from just below 5 kHz to just below 7 kHz, the first transfer function is outside the corridor defined over +/−g1 by the first limit value. Here, the first reference function is also slightly negative for this region, so that the difference T1-R1 (not shown) is again within the corridor and there is no seriously unusual behavior. However, the second transfer function T2 has a steadily increasing deviation from the second reference value R2, starting at approximately 2.5 kHz; above approximately 4.5 kHz it is also outside the corridor defined by the second limit value g2. Above approximately 6.5 kHz, the deviation of the second transfer function T2 from the second reference function R2 (the progression of which is substantially on the order of 0 dB to −5 dB, see FIG. 2B) already exceeds 20 dB, and continues to increase monotonically to well over 40 dB at 8 kHz. A comparable progression, differing only in that it has the opposite sign, is shown for the difference between first and second transfer functions T1-T2 shown in FIG. 3C.

It may be concluded in this case, that the first acoustic system 26, consisting of the output transducer 8, the corresponding acoustic feedback path 22 and the first input transducer 4, operates largely interference-free; however, a significant defect must be present in the second acoustic system 28, which is formed from the output transducer 8, the acoustic feedback path 24 and the second input transducer 6. The defect is thus attributable to the second input transducer 6.

The first transfer function T1 falling below the negative first limit value −g1 in FIG. 3A may additionally be regarded as an indication that the functionality is already slightly impaired at the first input transducer 4 too, but here—based on the corresponding progression of the first reference function—there is no critical behavior yet.

Figure 4A:
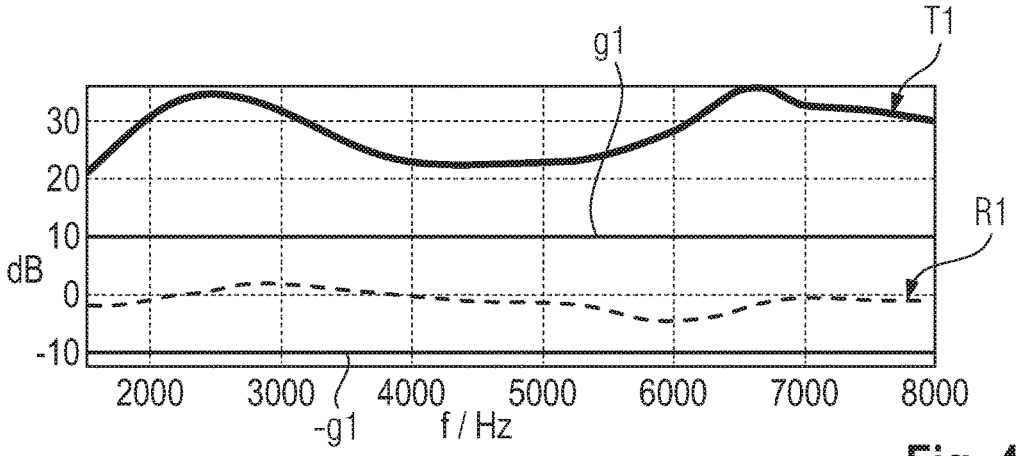
FIGS. 4A, 4B and 4C are graphs with comparisons of two transfer functions with the associated reference functions and with each other, in three frequency band diagrams for a hearing device with a defective output transducer.
Figure 4B:
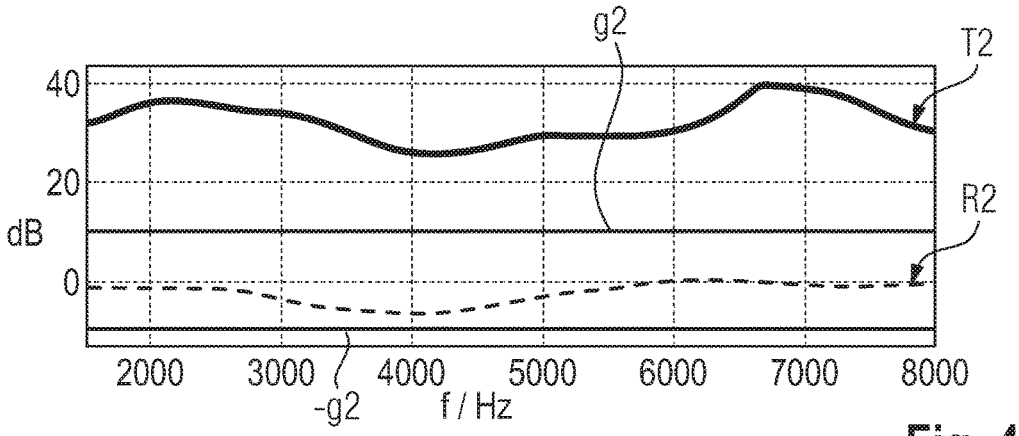
Figure 4C:
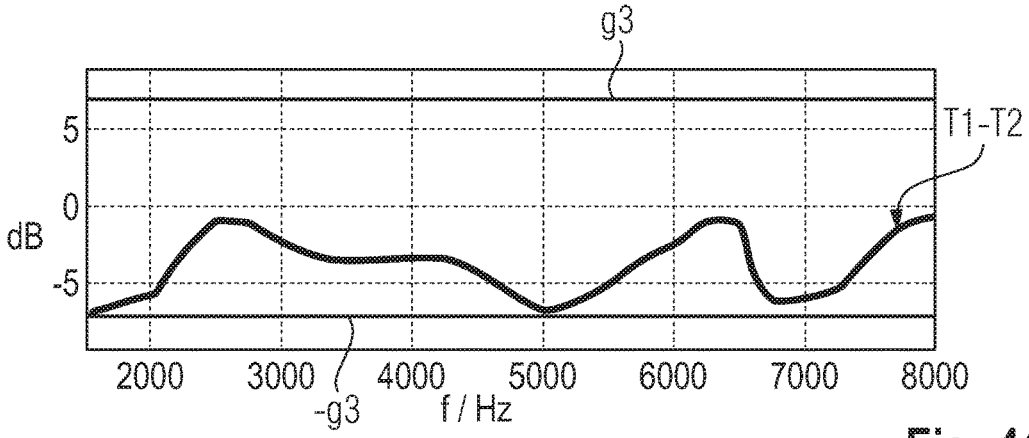

In the situation illustrated in FIGS. 4A-4C, both the first transfer function T1 (FIG. 4A) and the second transfer function T2 (FIG. 4B) are significantly outside the corridor defined by the first and second limit values g1, g2, and differ significantly from the respective reference functions R1 and R2, with the deviation being more than 20 dB even in the most favorable case. However, the difference between the first and the second transfer function T1-T2 shown in FIG. 4C lies within the corridor predetermined by the third limit value g3. This suggests that the defects that give rise to the significant deviations in the two diagrams in FIGS. 4A and 4B may be largely eliminated by subtraction.

The difference between the first transfer function T1 and the second transfer function T2 essentially reproduces the differences between the two acoustic feedback paths 22, 24 from the output transducer 8 to the first and second input transducers 4 and 6, and the differences between the two input transducers 4, 6. In addition, the differences in the acoustic feedback paths 22, 24 may be neglected, at least with respect to the contributions of the output transducer 8 in the first and second transfer functions, due to the considerable deviation from the respective reference function R1 or R2. This means that, in the present case, it may be concluded from the difference T1-T2 between the two transfer functions, which is relatively small compared to the deviations of the two transfer functions from the respective reference function T1-R1 or T2-R2, that the two input transducers 4, 6 are largely trouble-free, and thus the defect is in the output transducer 8.

Another way to inspect the open loop transfer function from the output transducer 8 via the respective acoustic feedback path 22 and 24 to the corresponding input transducer 4 and 6 with regard to defective hardware uses the cross-correlation of the respective transfer function T1 or T2 with the corresponding reference function R1 or R2 in the frequency domain and in the time domain.

Figure 5:
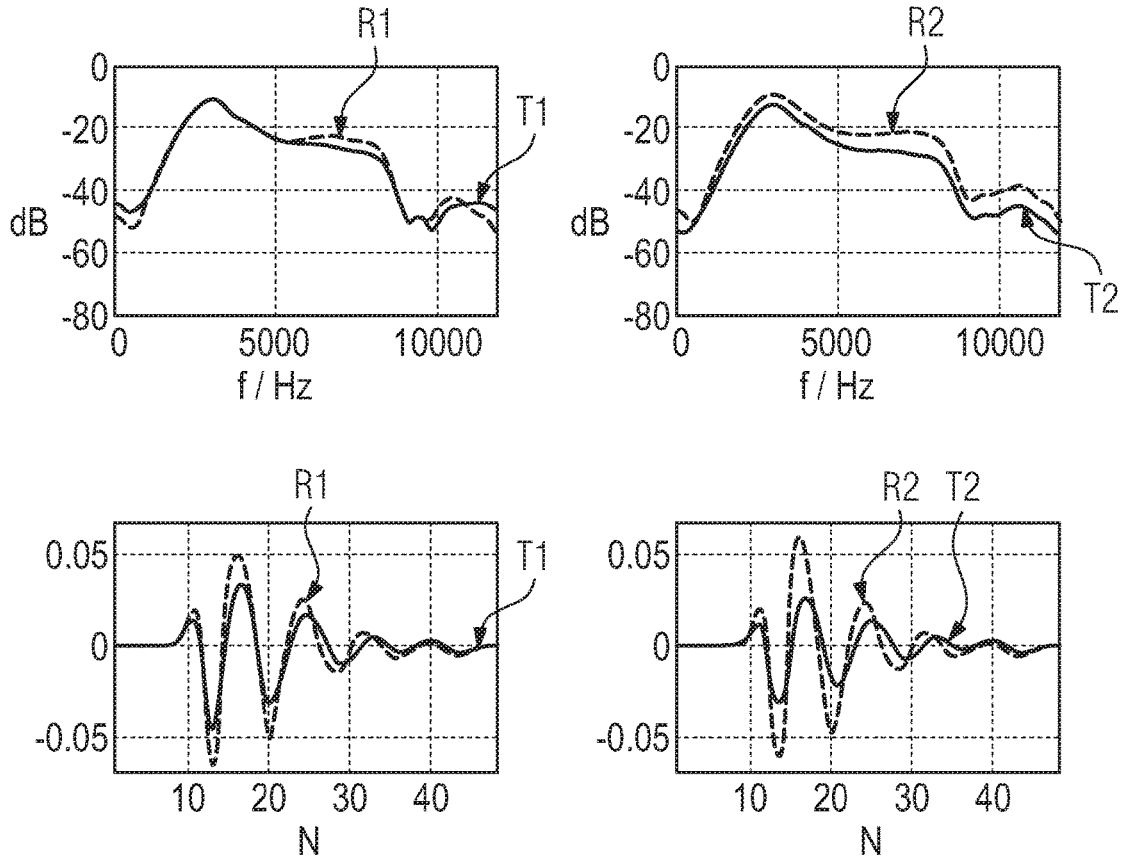
FIG. 5 shows the transfer functions of two open signal loops of an interference-free hearing device, as well as the associated reference functions, respectively in the frequency domain and the time domain.
Figure 6:
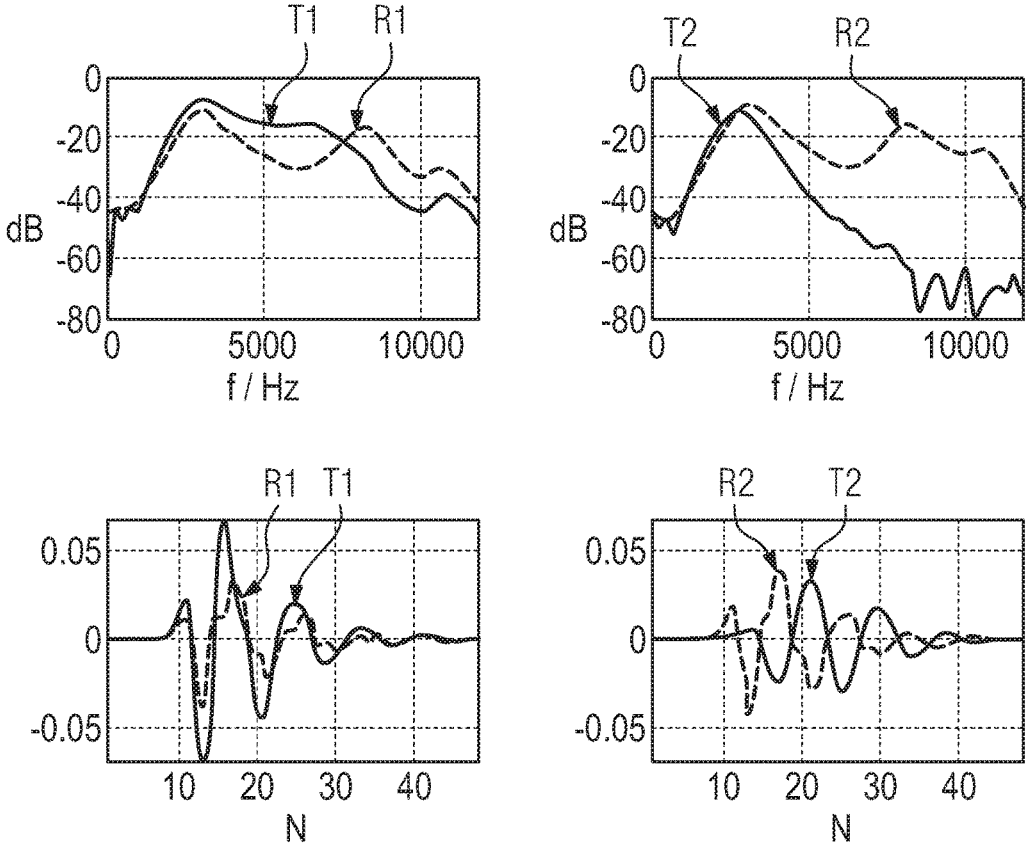
FIG. 6 shows the transfer functions of two open signal loops of a hearing device with a defective input transducer, as well as the associated reference functions, respectively in the frequency domain and the time domain.
Figure 7:
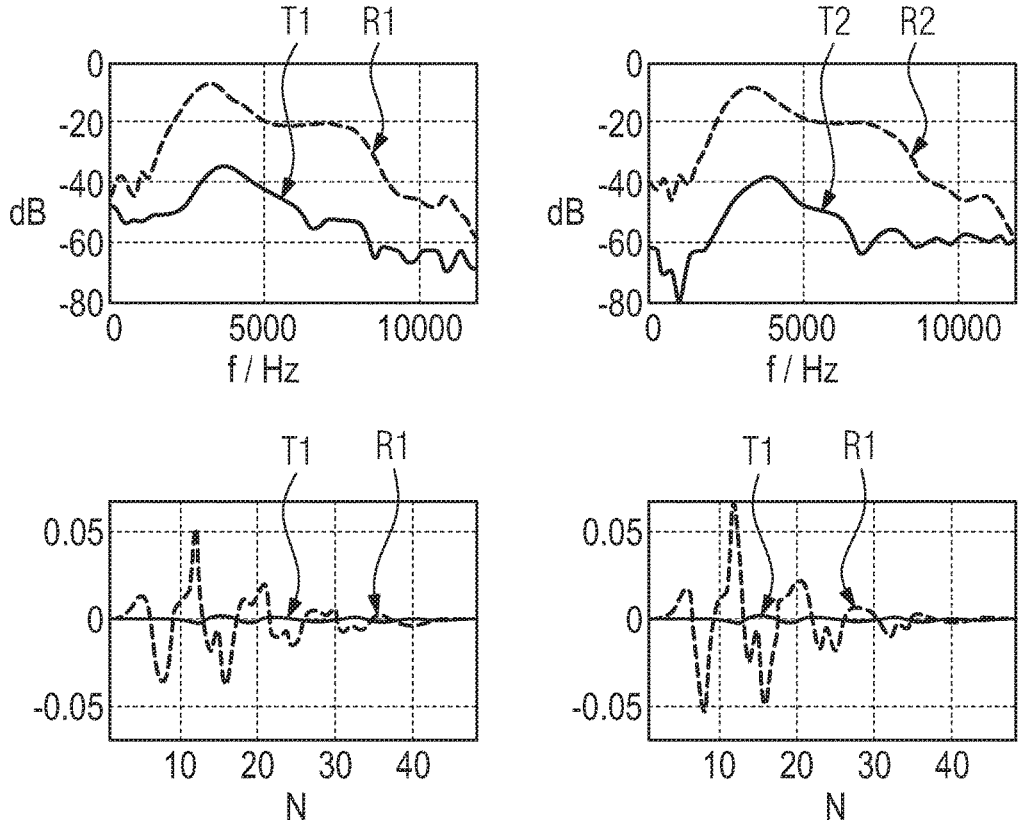
FIG. 7 shows the transfer functions of two open signal loops of a hearing device with a defective output transducer, as well as the associated reference functions, respectively in the frequency domain and the time domain.

This is illustrated by FIGS. 5 to 7. In the diagrams in the left column therein are plotted, respectively, the first transfer function T1 (solid lines) and the first reference function R1 (broken lines) against the frequency f/Hz (top left) and the corresponding impulse response of the first transfer function T1 and the first reference function R1, in the time domain, against the coefficient number N (bottom left of each diagram). The right column respectively shows the corresponding diagrams for the second transfer function T2 (solid lines) and the second reference function R2 (broken lines).

FIG. 5 shows a case that is comparable to the scenario described with reference to FIGS. 2A to 2C. The first input transducer 4, the second input transducer 6 and the output transducer 8 operate without problems. The deviations of the two transfer functions T1, T2 from the respective reference function R1, R2 are correspondingly small in the frequency space and Fourier space. The correlation coefficient is 1.0 respectively, with the exception of the cross-correlation between the second transfer function T2 and the second reference function R2 in the time domain, where the correlation is 0.9.

FIG. 6 is comparable to the scenario described with reference to FIGS. 3A to 3C. The first input transducer 4 and the output transducer 8 operate largely without interference, notwithstanding minor impairments of functionality; but the second input transducer 6 has a significant defect. The deviations of the second transfer function T2 from the second reference function are correspondingly clear in both diagrams in the right-hand column. In the frequency domain (top right) the correlation coefficient is only 0.3; in the time domain (bottom right) there is actually an anti-correlation of −0.7. The correlation coefficient of the first transfer function T1 with the first reference function R1 is 0.8 for both diagrams in the left column, indicating only a slight impairment.

The case illustrated in FIG. 7 is comparable to the scenario described with reference to FIGS. 4A to 4C. The first input transducer 4 and second input transducer 6 operate substantially without problems, but the output transducer 8 has a significant defect. A wide-band attenuation of the output power is visible in the deviations from the respective reference function R1, R2 for both the first and second transfer function T1 or T2 in the frequency domain (upper diagrams). Due to the low frequency dependence of the attenuation of the reproduction in the output transducer 8, the correlation coefficient for the two transfer functions T1, T2 in the frequency domain is 0.8 or 0.7. From this alone, however, it would not be possible to conclude that there was a significant impairment of a hardware function. The differences from the respective reference function R1, R2 become clear only by means of observations in the time domain (lower diagrams). The correlation coefficients in this case are −0.4 and −0.5. This means that in the present case the frequency response for both transfer functions T1, T2 differs substantially only by a translation from the respective reference function R1, R2, while the two impulse responses have significant deviations. From this it may be concluded that there is a defect of the output transducer 8.

Figure 8:
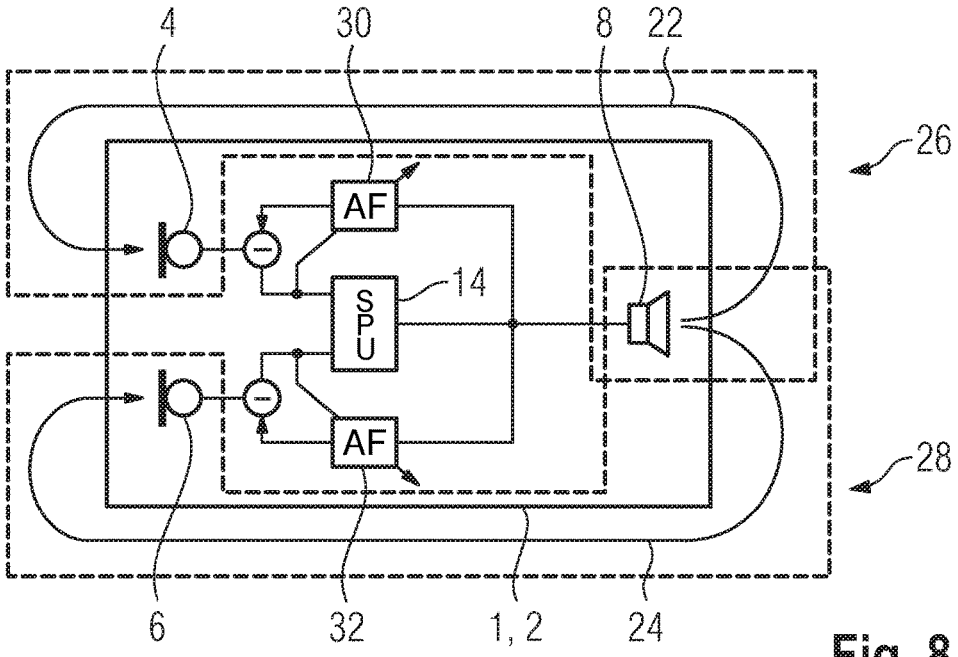
FIG. 8 is a block diagram of a hearing device, in which an alternative embodiment of the method for detecting defects of individual components is implemented.

FIG. 8 schematically shows a block diagram of a hearing instrument 1 designed as a hearing device 2, similar in its essential features to the hearing device according to FIG. 1. In order to be able to recognize a defect in the hearing device according to FIG. 8 at the first input transducer 4, the second input transducer 6 or the output transducer 8, no test sound signal 20 is output by the output transducer 8. Rather, adaptive filters (AF) 30, 32 are furnished for suppressing acoustic feedback along the acoustic feedback paths 22, 24, respectively. In these adaptive filters 30, 32 a transfer function is respectively estimated for the closed signal loops formed by the first acoustic system 26 and the second acoustic system 28 and the corresponding signal processing in the hearing device 2, these loops comprising the respective adaptive filter 30 or 32 and the signal processing unit 14. By knowing the internal transfer function of the signal processing unit 14, the transfer functions of the first acoustic system 26 and the second acoustic system 28 may be determined on the basis of the adaptive filters 30, 32.

The invention has been illustrated and described in detail by means of the preferred exemplary embodiment, but this embodiment does not limit the invention. Other variations may be deduced from this embodiment by a person of ordinary skill in the art, without departing from the protected scope of the invention.

The following is a summary list of reference numerals and the corresponding structure used in the above description of the invention:

1 Hearing instrument
2 Hearing device
4 First input transducer
6 Second input transducer
8 Output transducer
10 First input signal
12 Second input signal
14 Signal processing unit (SPU)
16 Output signal
18 Test signal
20 Test sound signal
22 Acoustic feedback path
24 Acoustic feedback path
26 First acoustic system
28 Second acoustic system
30 Adaptive filter (AF)
32 Adaptive filter (AF)
g1 First limit value
g2 Second limit value
g3 Third limit value
R1 First reference function
R2 Second reference function
T1 First transfer function
T2 Second transfer function

The invention claimed is:

1. A method of detecting a defect in a hearing instrument having a first input transducer and an output transducer, the method comprising:

determining a first transfer function of a first acoustic system including the output transducer and the first input transducer;

determining at least a first reference function for the first transfer function;

comparing the first transfer function with the first reference function;

detecting a defect in the hearing instrument based on a result of the comparing step;

determining a second transfer function of a second acoustic system comprising the output transducer and a second input transducer of the hearing instrument;

determining a second reference function for the second transfer function;

comparing the second transfer function with the second reference function;

detecting a defect in the hearing instrument based on a comparison of the first transfer function with the first reference function and based on a comparison of the second transfer function with the second reference function;

detecting a defect of one or both of the first input transducer and the output transducer;

predetermining a first limit value, a second limit value and a third limit value;

taking a first difference from the first transfer function and the first reference function;

taking a second difference from the second transfer function and the second reference function;

taking a third difference from the first transfer function and the second transfer function; and detecting a defect at the first input transducer when the first difference exceeds the first limit value in at least one frequency range, while the second difference does not exceed the second limit value; and/or detecting a defect in the output transducer when frequency ranges exist for the first difference and second difference respectively in which the first limit value or the second limit value is exceeded, yet the third difference does not exceed the third limit value.

2. The method according to claim 1, wherein the step of determining the first transfer function of the first acoustic system comprises determining an open loop transfer function, wherein an open signal loop is formed of the output transducer, an acoustic feedback path from the output transducer to the first input transducer.

3. The method according to claim 2, which comprises:

determining a further transfer function being a closed loop transfer function for a closed signal loop formed of the output transducer, an acoustic feedback path from the output transducer to the first input transducer, the first input transducer, and a signal processing path from the first input transducer to the output transducer; and determining therefrom the open loop transfer function as the first transfer function.

4. The method according to claim 3, which comprises:

determining the closed loop transfer function by an adaptive filter; and determining the open signal loop based on the closed signal loop, taking into account signal processing that takes place along the signal processing path.

5. The method according to claim 4, which comprises using the adaptive filter in the hearing instrument to suppress acoustic feedback via the acoustic feedback path that runs from the output transducer to the first input transducer.

6. The method according to claim 2, which comprises:

supplying a test signal to the output transducer;

causing the output transducer to generate a test sound signal from the test signal;

generating a first input signal with the first input transducer from an input sound comprising the test sound signal; and determining the open loop transfer function as the first transfer function from the first input signal and the test signal.

7. The method according to claim 1, which comprises using a cross-correlation for comparing the first transfer function with the first reference function.

8. The method according to claim 1, which comprises determining the first reference function from a measurement of the first transfer function under normalized conditions.

9. The method according to claim 1, which comprises determining the first reference function by time-averaging multiple values of the first transfer function at different times.

10. The method according to claim 2, which comprises determining the first transfer function by time-averaging a plurality of values of the open loop transfer function.

11. The method according to claim 1, which comprises detecting a defect of one or both of the first input transducer and the output transducer.

12. The method according to claim 1, which comprises:

determining a measure for a correlation between the first transfer function and the first reference function; and detecting the defect based on the measure of the correlation.

13. The method according to claim 1, which comprises:

determining a first polynomial which approximates the first transfer function;

determining a first reference polynomial which approximates the first reference function; and detecting the defect by comparing coefficients from the first polynomial and the first reference polynomial.

14. A hearing instrument, comprising at least one input transducer, at least one output transducer, and a signal processing unit configured to carry out the method according to claim 1.

15. The hearing instrument according to claim 14, configured as a hearing device.

16. A method of detecting a defect in a hearing instrument having a first input transducer and an output transducer, the method comprising:

determining a first transfer function of a first acoustic system including the output transducer and the first input transducer;

determining at least a first reference function for the first transfer function;

comparing the first transfer function with the first reference function;

detecting a defect in the hearing instrument based on a result of the comparing step, wherein the defect is a defect of one or both of the first input transducer and the output transducer; and detecting the defect by performing a set of steps selected from the group consisting of a first set and a second set;

wherein the first set includes: determining a measure for a correlation between the first transfer function and the first reference function, and detecting the defect based on the measure of the correlation; and wherein the second set includes: determining a first polynomial which approximates the first transfer function, determining a first reference polynomial which approximates the first reference function, and detecting the defect by comparing coefficients from the first polynomial and the first reference polynomial.

* * * * *